US006523511B2

(12) United States Patent
Hase

(10) Patent No.: US 6,523,511 B2
(45) Date of Patent: Feb. 25, 2003

(54) VALVE TIMING ADJUSTING APPARATUS FOR INTERNAL COMBUSTION ENGINE

(75) Inventor: Hirofumi Hase, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/849,351

(22) Filed: May 7, 2001

(65) Prior Publication Data

US 2002/0043231 A1 Apr. 18, 2002

(30) Foreign Application Priority Data

Aug. 9, 2000 (JP) ..... 2000-241749
Nov. 6, 2000 (JP) ..... 2000-337913

(51) Int. Cl.[7] ..... F01L 1/34

(52) U.S. Cl. ..... 123/90.17; 123/90.15; 74/568 R

(58) Field of Search ..... 123/90.12, 90.15, 123/90.17, 90.31; 74/568 R; 464/1, 2, 160

(56) References Cited

U.S. PATENT DOCUMENTS 5,845,615 A * 12/1998 Nakamura ..... 123/90.17
5,943,989 A * 8/1999 Kira ..... 123/90.17
6,058,897 A * 5/2000 Nakayoshi ..... 123/90.17
6,192,842 B1 * 2/2001 Haag ..... 123/90.17
6,263,843 B1 * 7/2001 Todo ..... 123/90.17
6,308,669 B1 * 10/2001 Lancefield ..... 123/90.15

FOREIGN PATENT DOCUMENTS

DE 199 03 624 A 8/1999
DE 199 18 910 A1 11/1999
DE 101 03 876 A1 9/2001
JP 11-62521 3/1999 ..... F01L/1/34

* cited by examiner

*Primary Examiner*—Thomas Denion
*Assistant Examiner*—Jaime Corrigan
(74) *Attorney, Agent, or Firm*—Sughrue Mion, PLLC

(57) ABSTRACT

A valve timing adjusting apparatus including a locking hole 8 formed in the external peripheral surface P of the boss of a rotor 3, into which the end portion of a locking pin 7*a* of the locking mechanism 7 is fitted when the rotor 3 is at the most advanced position. A stepped portion 9 is formed in the external peripheral surface of the rotor in a continuing manner from the locking hole 8 at a position deviated from the locking hole either in the advancing direction or the retarding direction in such a manner that it is formed lower than the external peripheral surface P, yet higher than the bottom of the locking hole 8, having two tapers 10, 11 respectively at the border between the stepped portion 9 and the external peripheral surface P, and that between the stepped portion 9 and the locking hole 8.

13 Claims, 13 Drawing Sheets

VALVE TIMING ADJUSTING APPARATUS FOR INTERNAL COMBUSTION ENGINE

BACKGROUND OF THE INVENTION

1. Field of the Invention

The present invention relates to a valve timing adjusting apparatus, which variably controls the timing for opening and/or closing either an intake valve or an exhaust valve in accordance with the driving state of an internal combustion engine.

2. Description of the Related Art

There have been proposed so far various vane-type valve timing adjusting apparatuses for controlling the timing for opening and/or closing either one or both of the intake valve and an exhaust valve of an internal combustion engine (hereinafter may be referred to just as an "engine"). Many of these apparatuses are of the vane-rotor type, and are equipped with a locking mechanism for fixing a rotor at a predetermined position, in order to eliminate a strange noise, vibration and so on at the engine starting time.

Further, there has also been provided such an apparatus as disclosed in Japanese Patent Application Laid-Open No. 11-62521, which is formed with a stepped portion in a locking hole for improving the locking ability of a locking member fitted therein.

However, if the above-mentioned valve timing adjusting apparatus is attached to an exhaust side camshaft, there is a possibility that, in a case where the rotor has been shifted only up to an intermediate position, engagement of the locking member with a larger-diameter portion of the locking hole cannot securely be performed, due to the fact that a tapered portion is not formed at the larger-diameter section, or the fact that a sufficient tapering, truncating, or rounding up process has not been applied to the end portion of the locking member, and there is also Another possibility that, in a case where the rotor has not been properly cramped by the locking member at the engine stopped state, it will not be securely cramped at its most advanced position at the engine starting time, so that a stable engine starting operation cannot be obtained.

The present invention has been proposed to solve the problems aforementioned, and it is an object of the present invention to provide a valve timing adjusting apparatus for internal combustion engine which is capable of stably operating the internal combustion engine, by assuredly locking the rotor even when the engine has just starting its operation at which an oil pressure is not sufficiently supplied.

SUMMARY OF THE INVENTION

The valve timing adjusting apparatus according to one aspect of the present invention is constructed in such a manner that it comprises: a shoe case, which rotates in synchronism with a crankshaft of an engine side, and having a plurality of shoes which are protruded from the inner surface of the shoe case and composing thereby a plurality of hydraulic chambers, a rotor, which is rotatably accommodated in the shoe case, and is formed with a plurality of vanes, which vanes dividing each of the plurality of hydraulic chambers into an advancing hydraulic chamber and a retarding hydraulic chamber, and a locking member, which is shiftable in the radial direction of the rotor, and can be fitted in and/or disengaged from a locking hole formed in the external peripheral surface of the rotor, wherein there is further formed a stepped portion in the external peripheral surface of the rotor in a continuing manner from the locking hole at a position deviated from the locking hole either in the advancing direction or retarding direction, which stepped portion being formed lower than the external peripheral surface, yet higher than the bottom of the locking hole.

The valve timing adjusting apparatus according to another aspect of the present invention is constructed such that the stepped portion is made to be substantially elongate, or an oval shape.

The valve timing adjusting apparatus according to further aspect of the present invention is constructed such that the stepped portion is made in a punched-out shape in the axial direction of the apparatus.

The valve timing adjusting apparatus according to further aspect of the present invention is constructed such that two tapers are formed each at the boarder between the external peripheral portion of the rotor and the stepped portion, and at the boarder between the locking hole and the stepped portion, wherein the taper formed at the boarder between the locking hole and the stepped portion is made shorter, yet its inclination angle is greater in comparison with the length and the inclination angle of the taper provided at the boarder between the external peripheral portion of the rotor and the stepped portion.

The valve timing adjusting apparatus according to further aspect of the present invention is constructed such that the end portion of the locking member is formed with a tapered portion whose inclination angle is equal to or larger than that of the taper provided at the boarder between the locking hole and the stepped portion.

The valve timing adjusting apparatus according to further aspect of the present invention is constructed such that the end portion of the locking member is formed with a surface truncated into a C shape or an R shape which is equal to or larger than that of the taper provided at the boarder between the locking hole and the stepped portion.

The valve timing adjusting apparatus according to further aspect of the present invention is constructed such that the area surrounding the stepped portion and the locking hole is processed by a quenching finish.

The valve timing adjusting apparatus according to further aspect of the present invention is constructed such that at least one of a plurality of advancing hydraulic chambers is formed with a bias member for urging the rotor in the advancing direction, The valve timing adjusting apparatus according to still further aspect of the present invention is constructed such that the locking hole is formed at a position corresponding to the reference position at the engine starting time, which is between the most advanced position and the most retarded position.

The valve timing adjusting apparatus of the above construction may be provided at the exhaust side camshaft.

The valve timing adjusting apparatus of the above construction may be provided at the intake side camshaft.

The valve timing adjusting apparatus according to still further aspect of the present invention comprises a locking member for controlling the free rotation of a casing that rotates in synchronism with a crank shaft at the internal combustion engine side and of a rotor rotatably provided in the casing, which locking member being fitted to the substantially intermediate position between the most advanced position and the most retarded position, wherein the locking member is composed of a far end portion, which is formed in a tapered shape, or truncated into a C shape or an R shape, and also a parallel portion.

In the valve timing adjusting apparatus according to still further aspect of the present invention, the rotor is further formed with two stepped portions in its external peripheral surface in a continuing manner from a locking hole at a position deviated from said locking hole in both the advancing direction and the retarding direction in a symmetrical manner, which stepped portion being formed lower than the external peripheral surface, yet higher than the bottom of the locking hole.

In the valve timing adjusting apparatus according to still further aspect of the present invention, each of the stepped portions are formed with a plurality of stairs.

The valve timing adjusting apparatus according to still further aspect of the present invention comprises a locking member for controlling the free rotation of a casing that rotates in synchronism with a crank shaft at the internal combustion engine side and of a rotor rotatably provided in the casing, which locking member being fitted to the substantially intermediate position between the most advanced position and the most retarded position, and shiftable in the diametrical direction of the apparatus by a spring force and an oil pressure, wherein the load of the spring urging the locking member in the diametrical inner direction of the apparatus is set in such a manner as to be larger than the centrifugal force applied to the locking member or than the force equivalent to the pressure of the residual oil in the apparatus at the engine starting time.

The valve timing adjusting apparatus according to still further aspect of the present invention is constructed such that even in a state that the spring urging the locking member in the diametrically inner direction of the apparatus is extended to the utmost level, thereby to fit the locking member into the locking hole formed in the external peripheral surface, the load of the spring is set in such a manner as to be larger than the centrifugal force applied to the locking member or than the force equivalent to the pressure of the residual oil in the apparatus at the engine starting time.

BRIEF DESCRIPTION OF THE DRAWINGS

FIGS. 19A and 19B are sectional views showing the magnified locking mechanism in the valve timing adjusting apparatus according to a seventh embodiment of the present invention, wherein FIG. 19A is a sectional view showing the spring in its extended state, whereas FIG. 19B is a sectional view showing the spring in its compressed state.

DETAILED DESCRIPTION OF THE PREFERRED EMBODIMENTS

Several embodiments for carrying out best the present invention are now explained with reference to attached drawings, in order to explain the present invention to details. It should be noted that the "upper portion" and "lower portion" referred to in the explanation about the constructions in the figures indicate the external side of the diametrical direction of the apparatus, and the internal side of the diametrical direction of the apparatus, respectively, as long as the directions are not specifically indicated in each of the explanations.

[First Embodiment]

Figure 1:
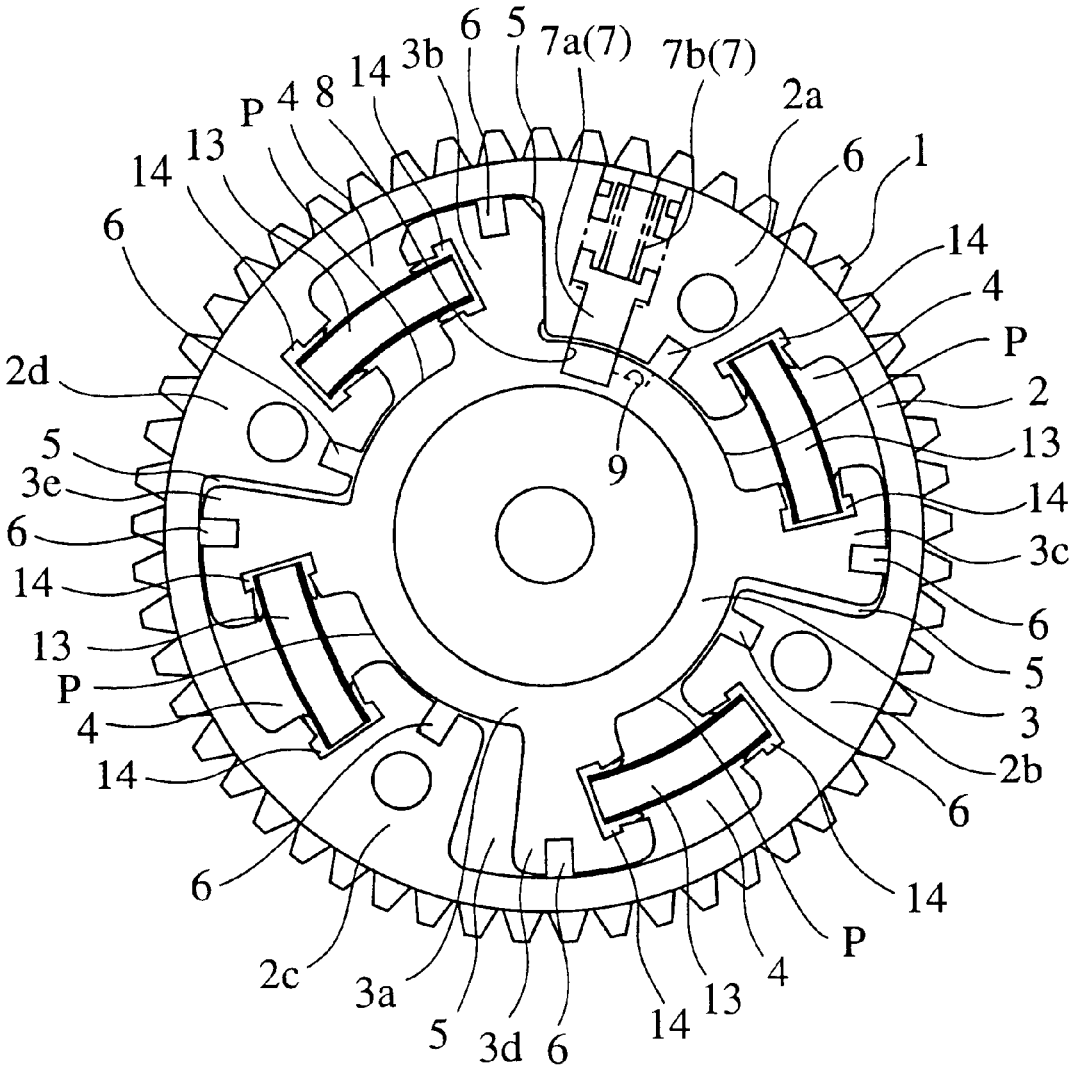
FIG. 1 is a sectional view showing the radially sectioned inner construction of a valve timing adjusting apparatus according to a first embodiment of the present invention.
Figure 2:
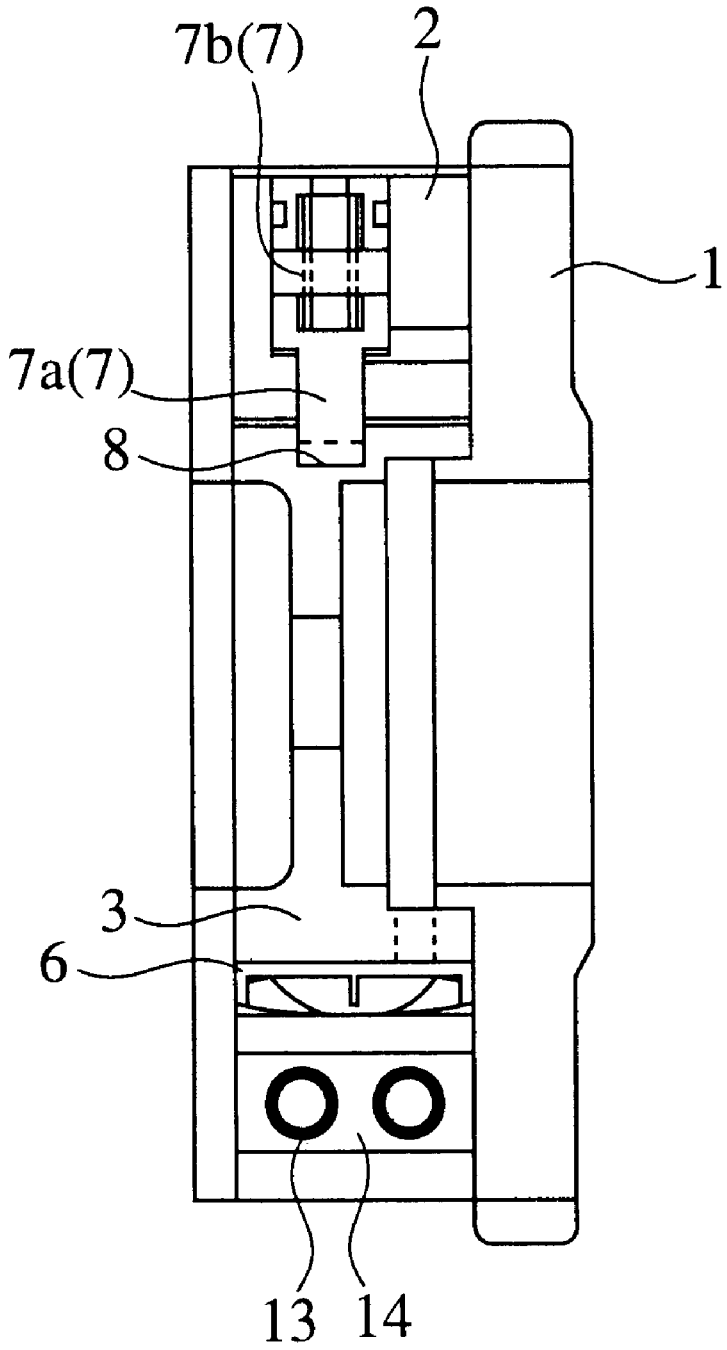
FIG. 2 is a sectional view of the axially sectioned apparatus of FIG. 1.

FIG. 1 is a sectional view showing the radially sectioned inner construction of a valve timing adjusting apparatus according to a first embodiment of the present invention, and FIG. 2 is a sectional view of the axially sectioned apparatus of FIG. 1.

In these figures, reference numeral 1 denotes a housing for integrally accommodating therein a chain sprocket or a timing pulley as a driven-force transmitting member that transmits a driven force from a crank shaft of an engine (not shown) to a camshaft at the exhaust side (not shown), wherein this housing rotates in synchronism with the rotation of the crank shaft. Reference numeral 2 denotes a casing which is fixed to the housing 1, and having a plurality of shoes 2*a* to 2*d* (explained later) configuring a plurality of hydraulic chambers, which shoes protruding from the inner peripheral surface of the casing. Reference numeral 3 denotes a rotor, which is fitted with the end portion of the camshaft (not shown), and having a plurality of vanes 3*b* to 3*e,* each projecting from the external peripheral surface P of a boss section 3*a* thereof, and dividing each of the above plurality of hydraulic chambers into an advancing hydraulic chamber 4 and a retarding hydraulic chamber 5. Further, numeral 6 denotes sealing members each provided at one end portion of each of the shoes 2*a* to 2*d,* and also at one end portion of each of the vanes 3*b* to 3*e* of the rotor 3, preventing the mutual oil flows between the advancing chamber 4 and the retarding chamber 5, thereby to maintain the oil pressure in each of the hydraulic chambers.

Provided in at least one of the shoes 2*a* to 2*d* of the casing 2 is a locking mechanism 7 for delimiting the free rotation of the rotor 3 with respect to the casing 2. This locking mechanism 7 is generally composed of a substantially cylindrical locking pin 7*a* and a spring 7*b* for urging this locking pin 7*a* in the radial direction of the casing 2. Further, the boss section 3*a* (or just "boss 3*a*" hereinafter) of the rotor 3 is formed with a locking hole 8 in the external peripheral surface P thereof for fitting the locking pin 7*a* (hereinafter may be referred to also as "locking member") of the locking mechanism 7 therein when the rotor 3 is set at a position corresponding to its most advanced side with respect to the casing 2 (hereinafter referred to just as the "most advanced position), and there is also formed with a stepped portion 9 in the external peripheral surface P at a position that is continued from the locking hole 8 and corresponding to the position of the rotor 3 when the rotor is rotated in the retarding direction, in such a manner that the stepped portion 9 is made lower than the external peripheral surface P of the boss 3*a* of the rotor 3, yet higher than the bottom of the locking hole 8. There are formed a taper 10 at the border between the external peripheral surface P and the stepped portion 9, and also another taper 11 at the border between the stepped portion 9 and the locking hole 8, which taper 11 being shorter than the taper 10 and the inclined angle thereof being greater than that of the taper 10. Specially, the taper 11 functions as a guide means for leading the locking pin 7*a* to the locking hole 8 when it is to be fitted therein, improving thus the locking efficiency of the locking pin 7*a*. The stepped portion 9 formed in the external peripheral surface P of the rotor 3 is made to be substantially elongate or an oval hole by a cutting process. Further, the area surrounding the stepped portion 9 and the locking hole 8 is processed by a quenching operation.

In each of the recesses 12 formed in the side surface of each of the shoes 2*a* to 2*d* of the casing 2 and in the side surface of each of the vanes 3*a* to 3*d* of the rotor 3, a supporting member 14 is provided for supporting a bias member 13 urging the rotor 3 in the advancing direction.

Next, the operation of the locking mechanism 7 is explained as below.

The locking pin 7*a* is urged toward the locking hole 8 of the rotor 3 by the spring 7*b* so as to be fitted therein. When the valve timing adjusting apparatus is not operating, the rotor 3 is cramped at the most advanced position by the engagement of the locking pin 7*a* and the locking hole 8. At this stage, the side surface of the shoe 2*a* of one of the shoes of the casing 2 and that of the vane 3*b* of one of the vanes of the rotor 3 are abutted against each other. While the rotor 3 is provided with an oil pressure in the advancing side, the casing 2 and the rotor 3 are put in a contact state at the above abutting surface, wherein the locking pin 7*a* is pushed back to the external side in the radial direction, and thus it is not fitted with the locking hole 8.

Next, when activating the valve timing adjusting apparatus, first an oil pressure toward the retarding direction is supplied from an oil control valve (not shown), and when this oil pressure becomes greater than the urging force of the spring 7*b,* the locking pin 7*a* is pushed back toward the external side in the radial direction against the urging force of the spring 7*b,* and at the same time, the rotor 3 rotates in the retarding direction. On the other hand, in the case of the reverse movement of the valve timing adjusting apparatus, when the rotor 3 is driven in the advancing direction, the locking pin 7*a* cramps the rotor 3 at the most advanced position, or otherwise, when there is sufficient oil pressure, although the locking pin 7*a* does not cramp the rotor 3, the rotor 3 is maintained at the most advanced position under the oil pressure.

As explained above, when there is sufficient oil pressure, the rotor 3 can be activated in the normal way. However, if there is not sufficient oil pressure provided at such timing as the engine starting time, the rotor cannot be maintained by the oil pressure. If the rotor 3 is rotated in its uncramped state, it is momentarily shifted in the advancing direction in the snapping manner by the cam reaction force, being abutted against the casing 2 at the most retarded position. However, if the rotor 3 is not shifted up to the most advanced position, the locking pin 7*a* cannot be fitted into the locking hole 8, and a strange noise such a drumming noise may be thereby caused. In order to eliminate this problem, in this first embodiment, there is formed the above-explained stepped portion 9 at the position continued from the locking hole 8 and corresponding to the position of the rotor 3 when the rotor is shifted in the retarding direction.

Figure 3A:
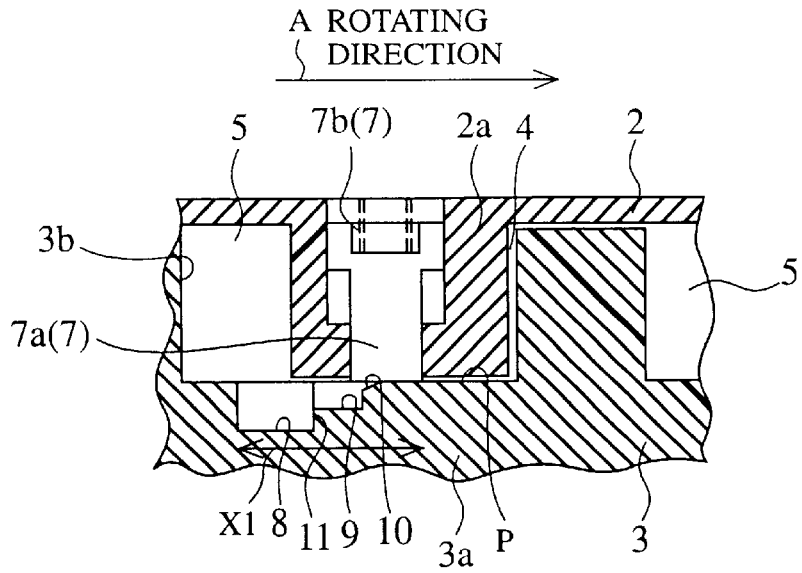
FIGS. 3A to 3C are magnified sectional views each showing the structure and operation of the locking mechanism in the valve timing adjusting apparatus shown in FIGS. 1 and 2.
Figure 3B:
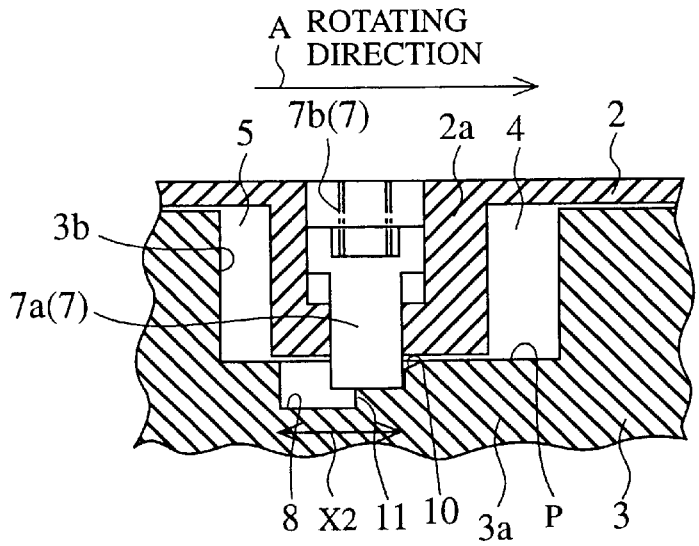
Figure 3C:
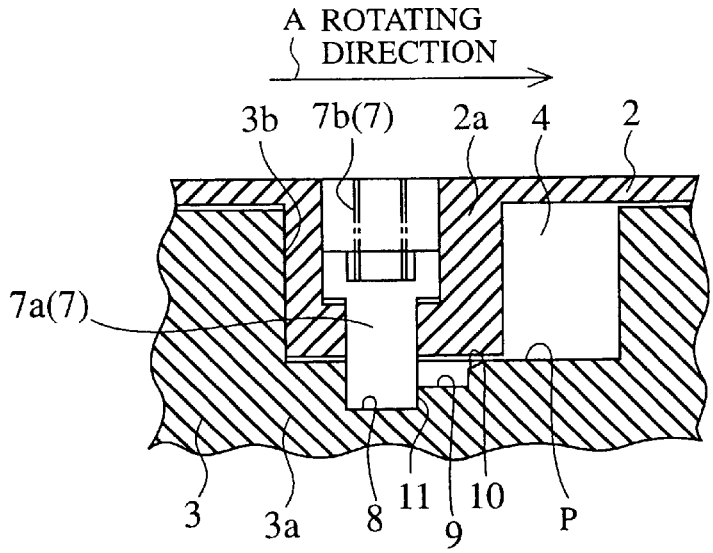
Figure 4:
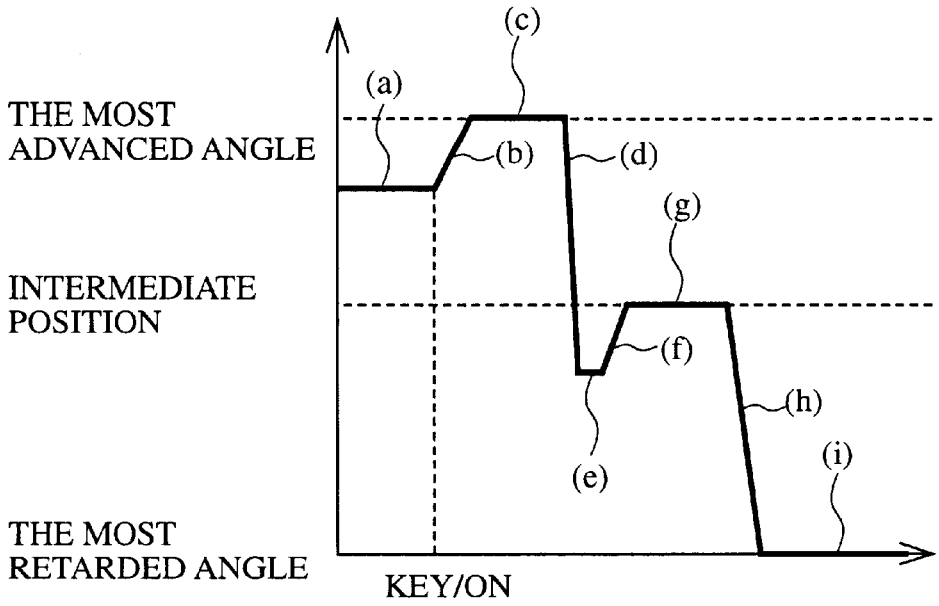
FIG. 4 is a graph showing the angular position of a rotor (and a camshaft) during the cranking operation at the engine starting time, in a case where the valve timing adjusting apparatus shown in FIG. 1 is attached to the exhaust side.

Next, the operation of the locking mechanism 7 and the angular position of the rotor are explained with reference to FIG. 4, taking up a specific period during which the cranking operation is being performed at the engine starting time. It is to be noted that since the angular position of the camshaft is same as that of the rotor, only about the angular position of the rotor is explained here. FIGS. 3A to 3C are magnified sectional views each showing the construction and operation of the locking mechanism in the valve timing adjusting apparatus as shown in FIGS. 1 and 2, wherein the direction indicated by a reference character "A" in these figures represents a rotating direction of the valve timing adjusting apparatus. FIG. 4 is a graph showing the angular position of the rotor (and the camshaft) during the cranking operation at the engine starting time in the case where the valve timing adjusting apparatus shown in FIG. 1 is attached to the exhaust side, wherein the axis of abscissas indicates the time lapse since the starting of the cranking, and the axis of ordinates indicates the angular position of the rotor.

In FIG. 4, the rotor 3 at the initial state of the engine starting time resides at the intermediate position between the most advanced position and the most retarded position; namely the position as indicated by (a). When the cranking is started, the rotor 3 is first shifted to the most retarded position as indicated by (b). Thereafter, the rotor 3 comes to the abutted state against the casing 2 at the most retarded position for a certain period as indicated by (c), and after that, when it is further rotated, the rotor 3 is shifted to the advancing side as indicated by (d) by the cam reaction force (or a valve spring reaction force) and also by the urging force of the bias member 13 in the advancing direction. During this period, the locking pin 7*a* is slidably shifted along the external peripheral surface P of the boss 3*a* of the rotor 3 by the urging force of the spring 7*b* within the extent indicated by Xi as shown in FIG. 3A. Next, in such a case where oil is full in the valve timing adjusting apparatus, for example, at the timing immediately after the stoppage of the engine and so on, the residual oil pressure operates as an oil pressure damper, whereby the rotor 3 is not only shifted to the most advanced position as indicated by (e), but even momentarily shifted backwards to the retarding direction as indicated by (f). Thereafter, by fitting the locking pin 7*a* into the stepped portion 9, the rotor 3 is cramped at the position as indicated by (g) within the range X2 as shown in FIG. 3B, without returning to the most retarded position. Still further, after passing through this period, the rotor 3 is shifted again by the cam reaction force (or a valve spring reaction force) in the advancing direction as indicated by (h), and the locking pin 7*a* is fitted into the locking hole 8 at the most advanced position as indicated by (i) as shown in FIG. 3C, and the rotor 3 is cramped. By this movement, the instability of the rotor 3 can be securely eliminated, whereby generation of a strange noise (drumming noise) and/or a vibration can be suppressed, assuring thus a stable engine starting operation.

As explained above, since the locking hole for locking the locking pin 7*a* is formed by a 2-step hole having a stepped portion according to the first embodiment of the present invention, even if the rotor 3 is not cramped by the locking pin during the engine-stop period, when the engine is resumed to start, the locking pin 7*a* is fitted into the locking hole 8 at least within one rotation of camshaft by the cam reaction force, and the rotor 3 is thereby cramped at its reference position, so that an engine starting operation without causing any strange noise, a vibration and so on can be realized.

Further, since according to the first embodiment of the present invention, the taper 10 is formed at the boarder between the external peripheral surface P of the boss 3*a* of the rotor 3 and the stepped portion 9, and also the taper 11, which is shorter than the taper 10, yet its inclined angle is greater than that of the taper 10, is formed at the boarder between the locking hole 8 and the stepped portion 9, the lowermost portion of the locking pin 7*a* can be received by these tapers 10 and 11, so that the locking pin 7*a* can be guided into the locking hole 8 quite easily, and thus the engaging efficiency of the locking pin 7*a* with the locking hole 8 can be greatly improved.

Still further, since according to this first embodiment, the area surrounding the stepped portion 9 and the locking hole 8 is processed by a quenching operation, even when the locking pin 7 a is abutted against it, the locking hole 8 is not worn out, improving thus its durability.

[Second Embodiment]

Figure 5A:
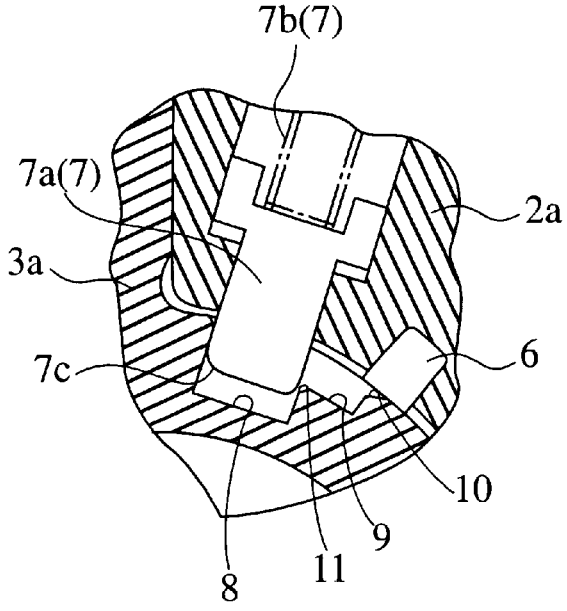
FIG. 5A is a sectional view showing a locking mechanism provided in the valve timing adjusting apparatus according to a second embodiment of the present invention.
Figure 5B:
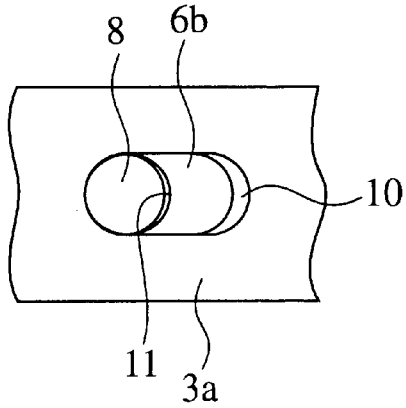
FIG. 5B is a plain view showing the construction of a locking hole and a stepped portion which are to be fitted with a locking pin of the locking mechanism shown in FIG. 5A.

FIG. 5A is a sectional view showing the locking mechanism provided in the valve timing adjusting apparatus according to a second embodiment of the present invention, and FIG. 5B is a plain view showing the construction of a locking hole and a stepped portion which are to be fitted with a locking pin of the locking mechanism shown in FIG. 5A. Note that the same or similar members in this second embodiment as or to those in FIG. 1 are put the same reference numerals for omitting a repetition of the same explanation.

The technical feature of this second embodiment resides in that the peripheral portion 7*c* of the lowermost portion (far end portion) of the locking pin 7*a* of the locking mechanism 7 is, as shown in FIG. 5A, truncated into an R shape, or into a round-up shape equal to or greater than tapers 10 and 11. Note that the peripheral portion 7*c* of the locking pin 7*a* is not limited to those arch or roundup shape, but can be made to a tapered shape whose inclination angle is substantially equal to or greater than those of the tapers 10 and 11, or truncated into a C-shape surface, which is even equal to or greater than those of the tapers 10 and 11.

According to this second embodiment, by making the peripheral portion 7*c* of the locking pin 7*a* into a tapered shape, in addition to the effect of the first embodiment, when the locking pin 7*a* abuts against the tapers 10 and 11, the impact can be mitigated, so that a smooth and secure fitting of the locking pin 7*a* into the locking hole is made possible.

[Third Embodiment]

Figure 6A:
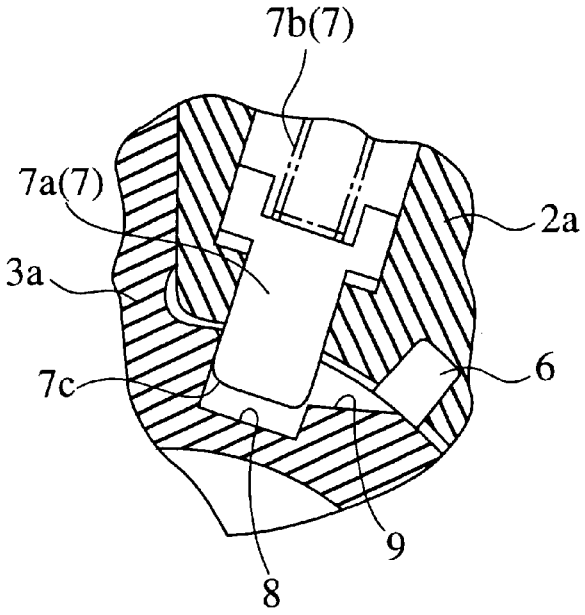
FIG. 6A is a sectional view showing the locking mechanism provided in the valve timing adjusting apparatus according to a third embodiment of the present invention.
Figure 6B:
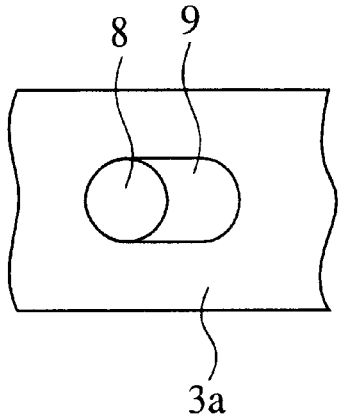
FIG. 6B is a plain view showing the construction of a locking hole and a stepped portion which are to be fitted with a locking pin of the locking mechanism shown in FIG. 6A.
Figure 7:
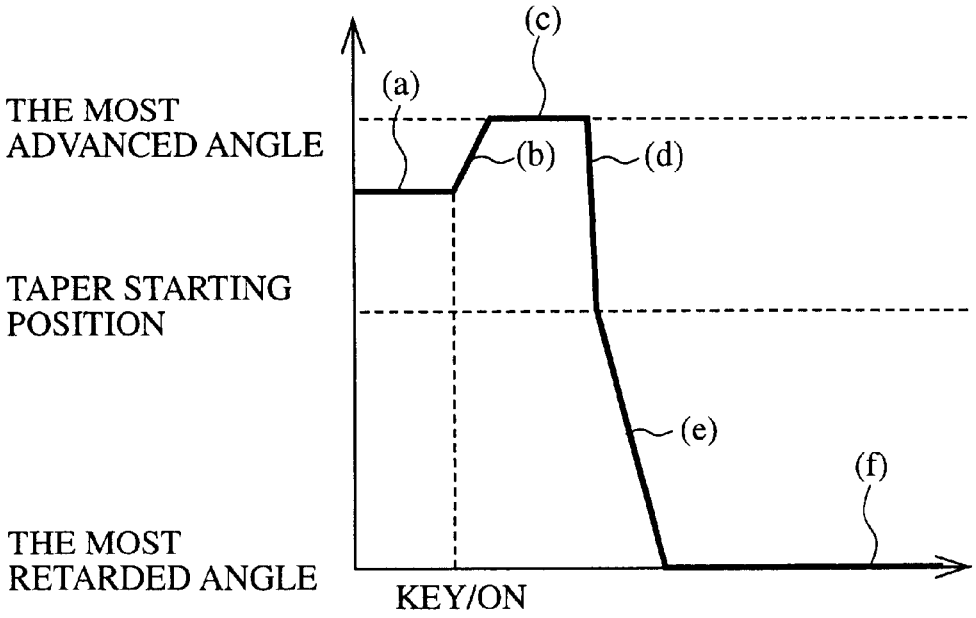
FIG. 7 is a graph showing the angular position of a rotor (and a camshaft) during the cranking operation at the engine starting time, in a case where the valve timing adjusting apparatus shown in FIGS. 6A and 6B is attached to the exhaust side.

FIG. 6A is a sectional view showing the locking mechanism provided in the valve timing adjusting apparatus according to a third embodiment of the present invention, and FIG. 6B is a plain view showing the construction of a locking hole and a stepped portion which are to be fitted with a locking pin of the locking mechanism shown in FIG. 6A. Further, FIG. 7 is a graph showing the angular position of a rotor (and a camshaft) during the cranking operation at the engine starting time in a case where the valve timing adjusting apparatus shown in FIGS. 6A and 6B is attached to the exhaust side, wherein the axis of abscissas shows the time lapse since the starting of the cranking, and the axis of ordinates shows the angular position of the rotor. Note that the same or similar members in this third embodiment as or to those in the first and second embodiments are put the same reference numerals for omitting a repetition of the same explanation.

The technical feature of this third embodiment resides in that the stepped portion 9 itself is made to be a tapered shape inclining towards the locking hole 8. By this construction, the slidability of the lowermost portion 7*c* of the locking pin 7 with respect to the stepped portion 9 can be improved.

Next, the operation of the locking mechanism 7 and the angular position of the rotor are explained with reference to FIG. 7, taking up a specific period during which the cranking operation is being performed at the engine starting time. In FIG. 7, the initial state of the rotor 3 is located in the intermediate portion between the most advanced position and the most retarded position, namely the position as indicated by (a). When the cranking is started, the rotor 3 is first shifted to the most retarded position as indicated by (b). Thereafter, the rotor 3 comes to the abutted state against the casing 2 at the most retarded position for a certain period as indicated by (c), and after that, when it is further rotated, the rotor 3 is shifted to the advancing side as indicated by (d) by the cam reaction force (or a valve spring reaction force). When the rotor 3 is shifted in the advancing direction and the locking pin 7*a* is brought into contact with the tapered stepped portion 9, the locking pin 7*a* is slided along the stepped portion 9 by the urging force of the spring 7*b*. By this sliding movement, the rotor 3 is shifted in the advancing direction as indicated by (e), being cramped in such a manner as not to be shifted in the retarding direction. When it is further rotated, the locking pin 7*a* is fitted into the locking hole 8, and the rotor 3 is cramped at the most advanced position as indicated by (f).

As explained above, even if the rotor 3 is not cramped by the locking pin during the engine-stopped period, when the engine is resumed to start, the locking pin 7*a* is fitted into the locking hole 8 at least within one rotation of camshaft by the cam reaction force, and the rotor 3 is thereby cramped at its reference position, so that the instability of the rotor 3 can be assuredly eliminated, and an engine starting operation without causing any strange noise, a vibration and so on can be realized.

[Fourth Embodiment]

Figure 8:
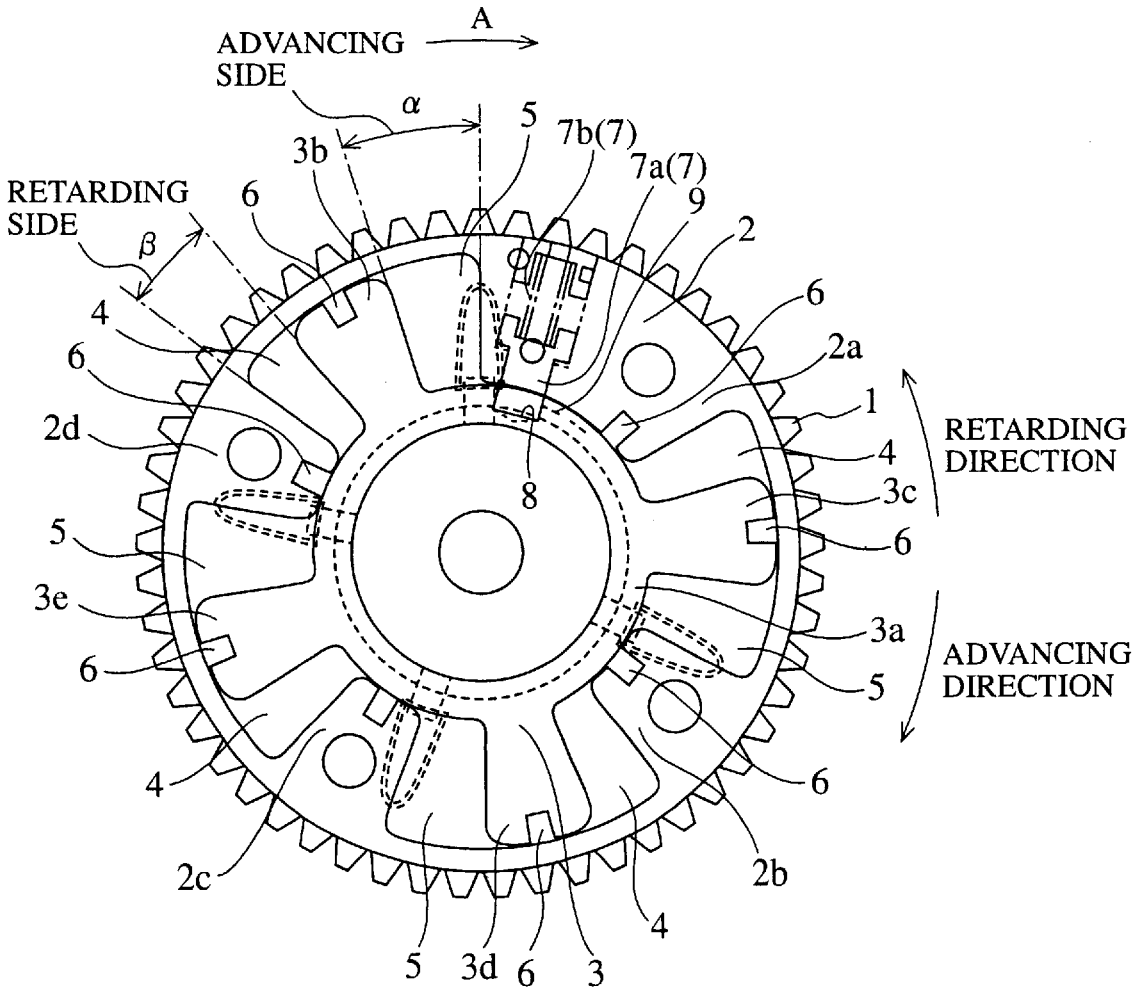
FIG. 8 is a sectional view showing the radially sectioned inner construction of a valve timing adjusting apparatus according to a fourth embodiment of the present invention.
Figure 9:
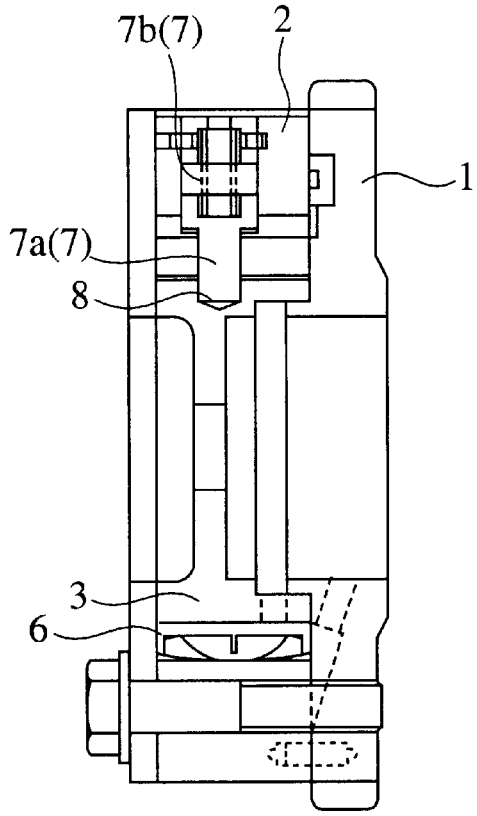
FIG. 9 is a sectional view of the axially sectioned apparatus of FIG. 8.
Figure 10:
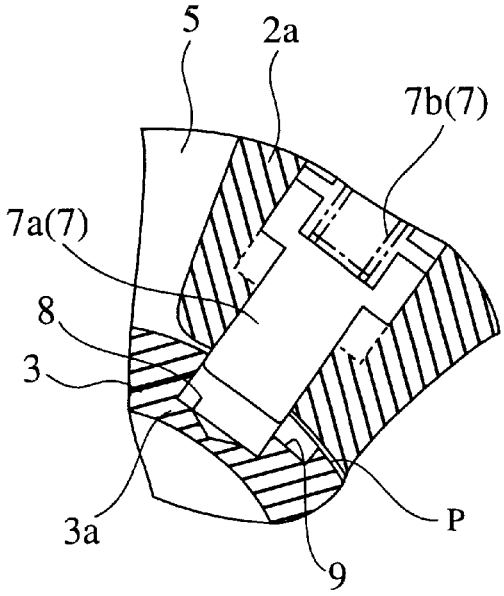
FIG. 10 is a sectional view showing the construction of the locking mechanism in the valve timing adjusting apparatus shown in FIGS. 8 and 9.

FIG. 8 is a sectional view showing the radially sectioned inner construction of a valve timing adjusting apparatus according to a fourth embodiment of the present invention, and FIG. 9 is a sectional view of the axially sectioned apparatus of FIG. 8, and further, FIG. 10 is a sectional view showing the construction of a locking mechanism provided in the valve timing adjusting apparatus shown in FIGS. 8 and 9. Note that the same or similar members in this fourth embodiment as or to those in the first to third embodiments are put the same reference numerals for omitting a repetition of the same explanation.

In the first to third embodiments, since it is arranged such that the stepped portion 9 into which the locking member 7*a* is to be fitted is formed at a position that is continued from the locking hole 8 and corresponding to the position of the rotor 3 when the rotor is shifted in the retarding direction, even if the rotor 3 is not cramped at the engine stopped state, the locking member 7*a* is securely fitted into the locking hole 8 to cramp the rotor 3 at the engine restarting time, thereby enabling a stable engine start operation free of strange noises, vibrations and so on. Here, the reference position at the initial engine operating state is the position at which the rotor 3 comes into contact with the casing 2 at the most advanced position. However, it can be arranged such that the reference position of the rotor 3 at the engine starting operation is set at a position between the most advanced position and the most retarded position.

Next, the above construction is explained into details according to this fourth embodiment.

In this embodiment, as shown in FIG. 8, a predetermined shifting angle $\alpha$ of the rotor 3 is set in its advancing side, and a predetermined shifting angle $\beta$ is set in its retarding side, with a locking hole 8 being formed at the position where these settings are made possible. In other words, the locking member 7*a* and the locking hole 8 are set in such a manner that the rotor 3 can be cramped at the position corresponding to the reference position at the engine starting time, and the rotor can be shifted in both the advancing and retarding directions from that position, namely for the angle $\alpha$ in the advancing direction, and for the angle $\beta$ in the retarding direction. In addition, the stepped portion 9 is formed at a position corresponding to the position where the rotor 3 is shifted in the retarding direction from the locking hole 8.

Next, the operation of the above construction is explained below.

Even when the locking pin 7*a* has been disengaged from the locking hole 8 at the engine stopped state, at least during the cranking operation at the engine restarting time, the rotor 3 is snapped by the cam reaction force in the advancing direction, so that the locking pin 7*a* can be securely fitted into the locking hole 8 by way of the stepped portion 9 to enable a stable engine starting operation. Here, at the engine starting time, by arranging an oil path in such a manner that it makes the feeding of an oil pressure to the valve timing adjusting apparatus by means of an oil control valve to be an oil feeding into the advancing chamber (the direction in which the rotor 3 is shifted), and the retarding chamber to be a drain, the residual oil in the retarding chamber is prevented from operating as an oil damper at the time when the rotor 3 is snapped in the advancing direction, whereby the amount of shifting of the rotor 3 in the advancing direction can be made even larger.

Next, by arranging an oil path such that the oil control valve feeds an oil pressure to the advancing chamber, the oil pressure fed from the oil pump is supplied also to the locking mechanism after the full explosion of the engine, and the locking pin 7*a* is pushed back to the external side in the diametrical direction of the apparatus, against the urging force of the spring 7*b*. In other words, the cramping of the rotor 3 is released, and the rotor 3 is shifted in the advancing direction by the oil pressure. In this way, by attaching the valve timing adjusting apparatus to the exhaust side camshaft as shown in this fourth embodiment, an exhaust valve can be controlled to shift in the advancing direction at the engine starting time, and thus a high-temperature gas immediately after the explosion within the engine cylinder can be fed to a catalyst side as an exhaust gas, whereby the temperature of the catalyst can be raised abruptly to the grade higher than the activation temperature, so that even if the engine is started at a low temperature, detrimental substance contained within the exhaust gas passing through the catalyst can be efficiently rendered harmless. Thus, even at an abnormal operating state, such as the engine starting time, detrimental substance exhausted into the air can be reduced, thereby preventing an environmental disruption. In addition, by controlling the exhaust valve to operate in the retarding direction during the normal operation, torque rate can also be enhanced.

The above-explained effects are extremely useful for minimizing the amount of ternary catalyst made of palladium, platinum and rhodium, and also minimizing the bad effects to the environment of the detrimental substance such as THC, CO, NOx and so on included in the exhaust gas.

Further, the fuel efficiency or minimization of emission can also be obtained by attaching the apparatus to the exhaust side camshaft to perform retarding control, or by attaching the apparatus to the intake side camshaft to perform the conventional advancing control and so on.

Figure 11:
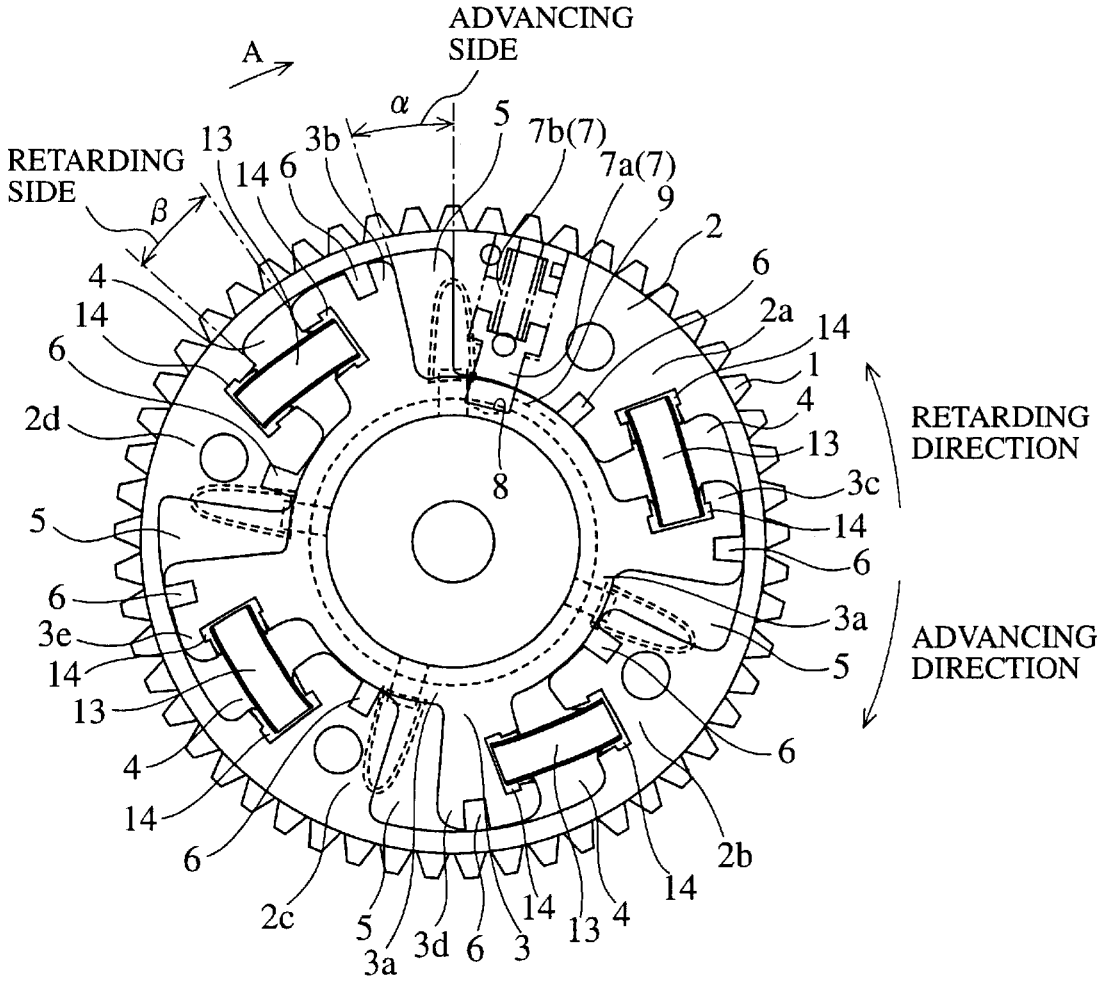
FIG. 11 is a sectional view showing the radially sectioned inner construction of a modified example of the valve timing adjusting apparatus of the before-mentioned fourth embodiment of the present invention.

FIG. 11 is a sectional view showing the radially sectional inner construction of a modified example of the valve timing adjusting of the fourth embodiment of the present invention.

The technical feature of this modified example resides in that a bias means 13 for urging the rotor 3 in the advancing direction is provided. This bias means 13 aides the rotor 3 to rotate in the advancing direction, and in this case also, it can be sifted in both the advancing and retarding directions from the locked position corresponding to the reference position thereof at the engine starting time. Further, according to this modified example, the amount of shifting of the rotor 3 in the advancing direction at the cranking operation during the engine starting term can be made larger, thereby the locking efficiency of the locking pin 7*a* can be improved.

[Fifth Embodiment]

Figure 12:
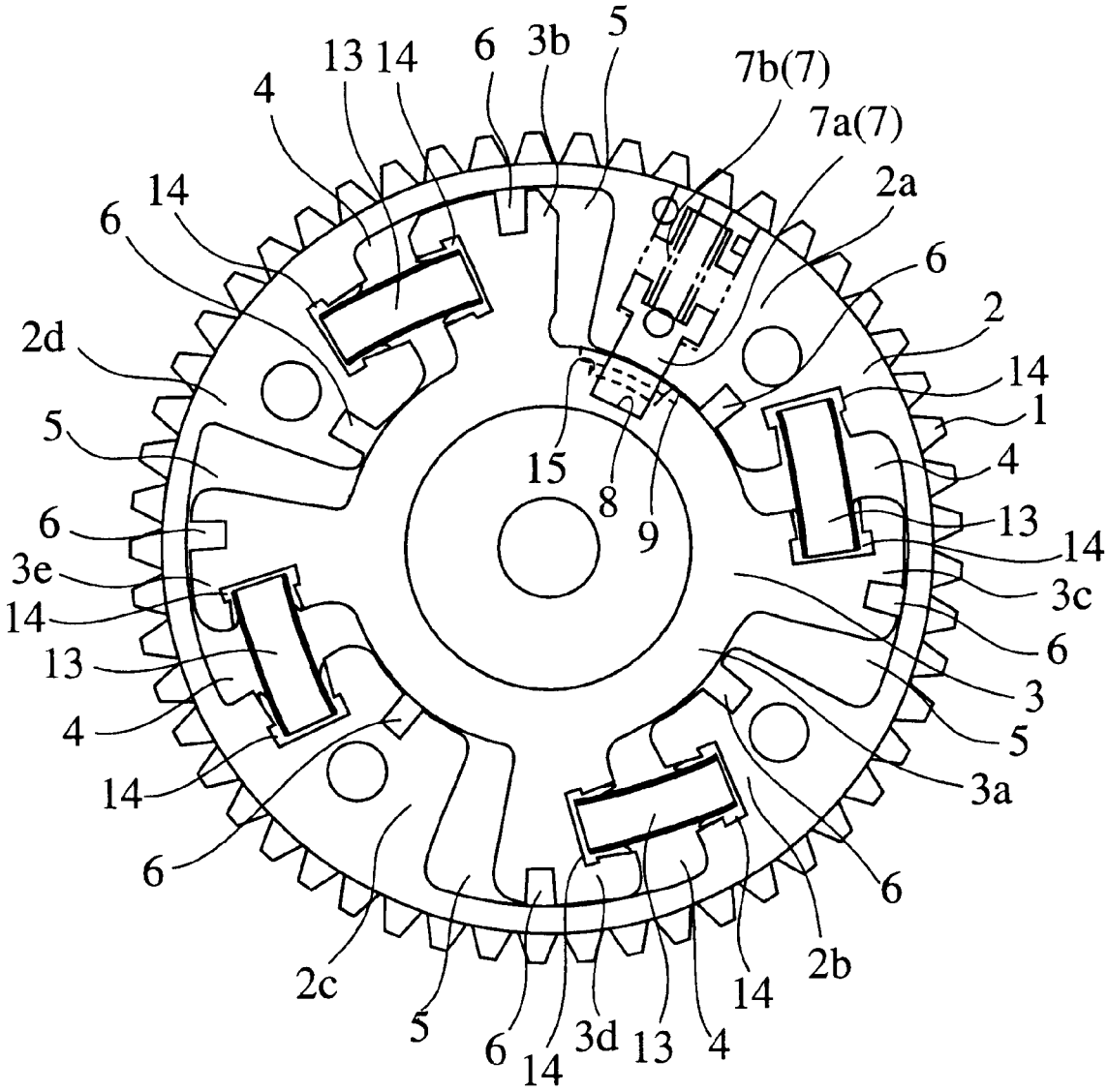
FIG. 12 is a sectional view showing the radially sectioned inner construction of the valve timing adjusting apparatus according to a fifth embodiment of the present invention.
Figure 13:
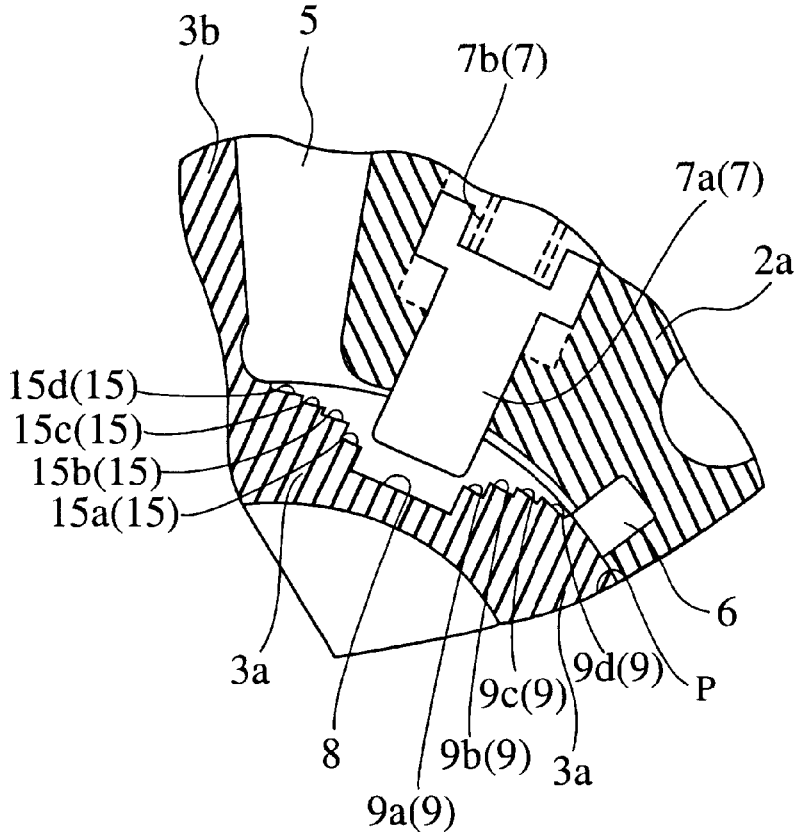
FIG. 13 is a sectional view showing the inner construction of the locking mechanism in the valve timing adjusting apparatus shown in FIG. 12.
Figure 14:
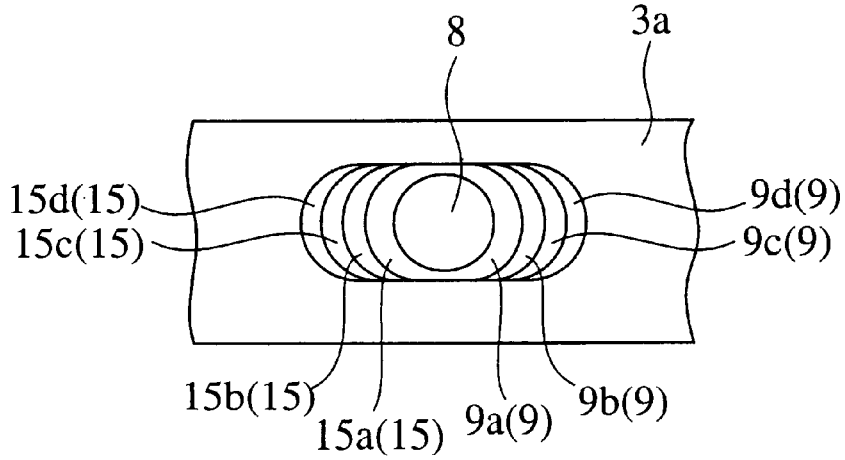
FIG. 14 is a plain view showing the construction of a locking hole and a stepped portion which are to be fitted with a locking pin of the locking mechanism shown in FIG. 13.

FIG. 12 is a sectional view showing the radially-sectioned inner construction of the valve timing adjusting apparatus according to a fifth embodiment of the present invention, and FIG. 13 is a sectional view showing the inner construction of the locking mechanism in the valve timing adjusting apparatus shown in FIG. 12, and further FIG. 14 is a plain view showing the construction of a locking hole and a stepped portion which are to be fitted with a locking pin of the locking mechanism shown in FIG. 13. Note that the same or similar members in this fifth embodiment as or to those in the first to fourth embodiments are put the same reference numerals for omitting a repetition of the same explanation.

The technical feature of this fifth embodiment resides in that not only the stepped portion 9 formed at the advancing side of the locking hole 8 is made in a step-like shape from the external peripheral surface P of the boss 3*a* of the rotor 3 to the bottom of the locking hole 8, but also a second stepped portion 15 is formed in a step like shape at the retarding side of the locking hole 8 in a symmetrical manner with the stepped portion 9. The stepped portion 9 is composed of four stairs, namely stairs 9*a,* 9*b,* 9*c* and 9*d,* wherein the second stepped portion 15 is, in this case for example, composed of four stairs; namely the stairs 15*a,* 15*b,* 15*c* and 15*d.*

As explained above, in this fifth embodiment, even if the locking pin 7*a* is disengaged from the locking hole 8 at the engine stopped time, during the cranking operation at the engine restarting time, the locking pin 7*a* is fitted either into the stepped portion 9 or the second stepped portion 15 in a step by step manner, and finally it can be fitted into the locking hole 8.

Further, in this fifth embodiment, by disengaging the locking pin 7*a* from the locking hole 8 at the engine idling time, the advancing control for the catalyst activation and the retarding control for raising the torque during the normal operation can be realized. However, in order to realize this, it is necessary to enable the rotor 3 maintained between the most advanced position and the most retarded position at the idling time against the cam reaction force (cam load) by the oil pressure at the idling time and by the urging force 13 in the advancing direction.

[Sixth Embodiment]

Figure 15:
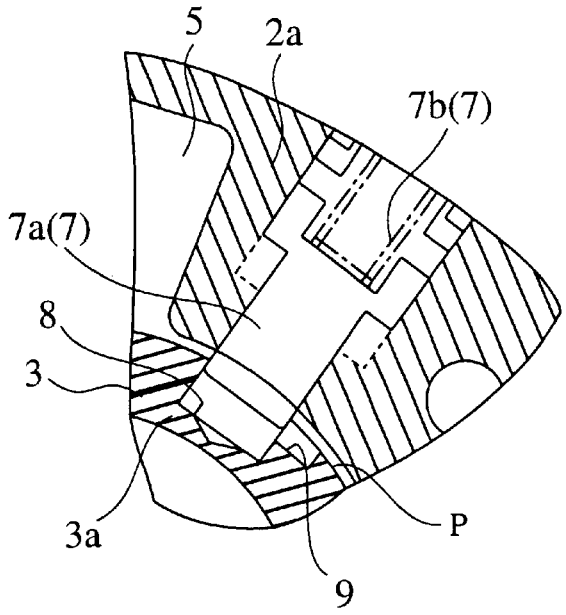
FIG. 15 is a sectional view showing the magnified locking mechanism in the valve timing adjusting apparatus according to a sixth embodiment of the present invention.
Figure 16:
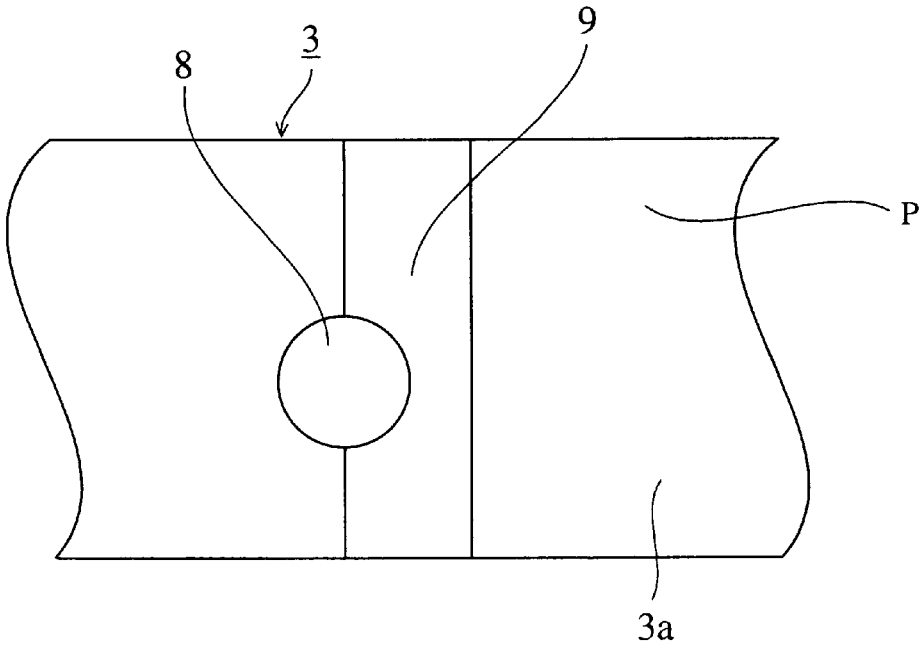
FIG. 16 is a plain view showing the construction of a locking hole and a stepped portion which are to be fitted with a locking pin of the locking mechanism shown in FIG. 15.

FIG. 15 is a sectional view showing the magnified locking mechanism in the valve timing adjusting apparatus according to a sixth embodiment of the present invention, and FIG. 16 is a plain view showing the construction of a locking hole and a stepped portion which are to be fitted with the a locking pin of the locking mechanism shown in FIG. 15. Note that the same or similar members in this sixth embodiment as or to those in the first to fifth embodiments are put the same reference numerals for omitting a repetition of the same explanation.

In the first to fifth embodiments, the stepped portion 9 is made to be substantially elongate, or an oval shape, and in this case, this stepped portion 9 should be formed by a machining process. However, in this sixth embodiment, the stepped portion 9 is, as shown in FIGS. 15 and 16, made in a punched-out shape in the axial direction of the apparatus. By making this way, the stepped portion 9 can be integrally formed by a metal-pattern, thereby to lower the total cost for its manufacturing process. Note that the locking hole 8 has a larger diameter than the external diameter of the locking pin 7*a,* just as the case of the first to fifth embodiments.

[Seventh Embodiment]

Figure 17:
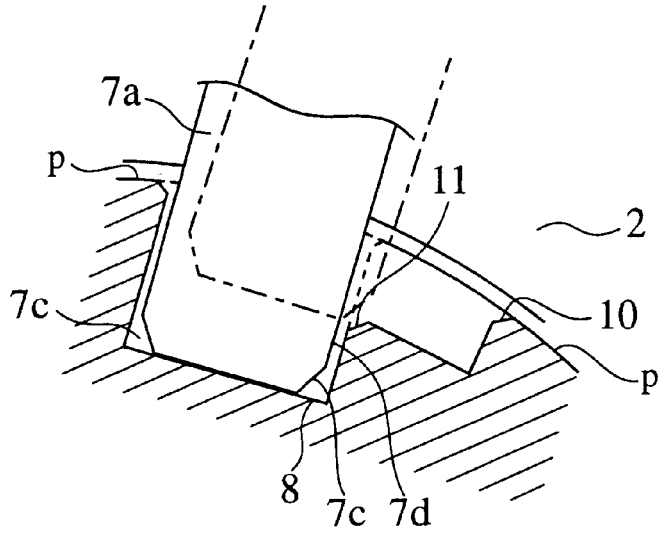
FIG. 17 is a sectional view showing the magnified locking mechanism in the valve timing adjusting apparatus according to a seventh embodiment of the present invention.

FIG. 17 is a sectional view showing the magnified locking mechanism in the valve timing adjusting apparatus according to a seventh embodiment of the present invention. Note that the same or similar members in this seventh embodiment as or to those in the first embodiment are put the same reference numerals for omitting a repetition of the same explanation.

In this seventh embodiment, the locking hole 8 formed in the outer peripheral portion of the rotor 3 is at the substantially intermediate position between the most advanced position and the most retarded position. The locking pin 7*a* is formed with a tapered shape at the peripheral portion 7*c* of its far end, and its external peripheral surface is made to be a parallel portion 7*d* which is made in parallel with the inner peripheral surface of the locking hole 8. The dotted chain line in the figure indicates the position of the locking pin 7*a* before or after it is fitted into the locking hole 8. Further, provided adjacent to the locking hole 8 in the continued manner is a stepped portion 9 formed with the tapers 10 and 11 just as the case of the second embodiment shown in FIG. 5.

In the locking mechanism having the above construction, during the operating period of the apparatus, the locking pin 7*a* is forced to be shifted in the diametrical direction of the apparatus (in this case, the radial direction of the rotor 3 for example) by an oil pressure, and a so-called "twisting" phenomenon is caused thereby, so that there is a fear that the apparatus comes to an inoperable state. However, in this seventh embodiment, by forming the peripheral portion 7*c* of the locking pin 7*a* as a tapered shape, even when a force in the diametrical direction is applied to the locking pin 7*a,* no "twisting" phenomenon is caused to the locking pin 7*a,* and the locking pin 7*a* can thus assuredly be disengaged from the locking hole 8, whereby a stable operability of the apparatus can be obtained.

Further, in this seventh embodiment, the peripheral portion 7*c* of the locking pin 7*a* is formed in a tapered shape, and also the parallel portion 7*d* is continued from this peripheral portion 7*c,* the fitting margin, which is available when the locking pin 7*a* is fitted into the locking hole 8, can be assured, the locking pin 7*a* can thereby be securely fitted into the locking hole 8, and thus the rotor 3 can be securely cramped with respect to the casing 2.

Figure 18:
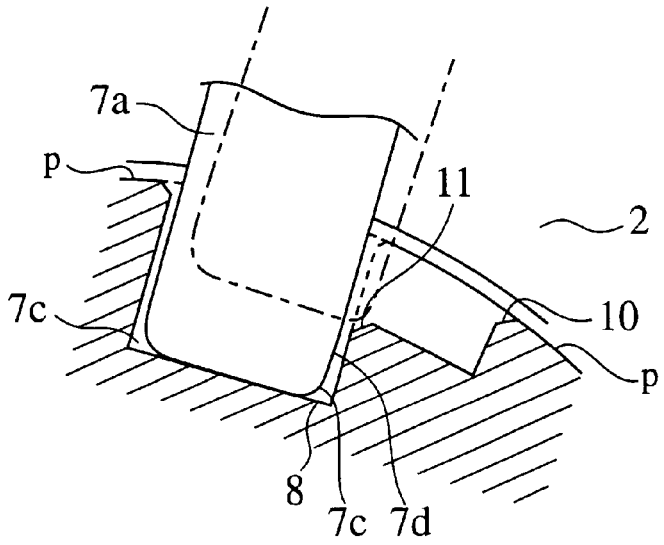
FIG. 18 is a sectional view showing the magnified locking mechanism of a modified example in the valve timing adjusting apparatus. of the seventh embodiment of the present invention.

Note that although the peripheral portion 7*c* of the locking pin 7*a* is formed in a tapered shape in FIG. 7, the present invention is not limited to this construction, but the peripheral portion 7*c* can be truncated into an R shape, or even C shape as shown in FIG. 18.

Figure 19A:
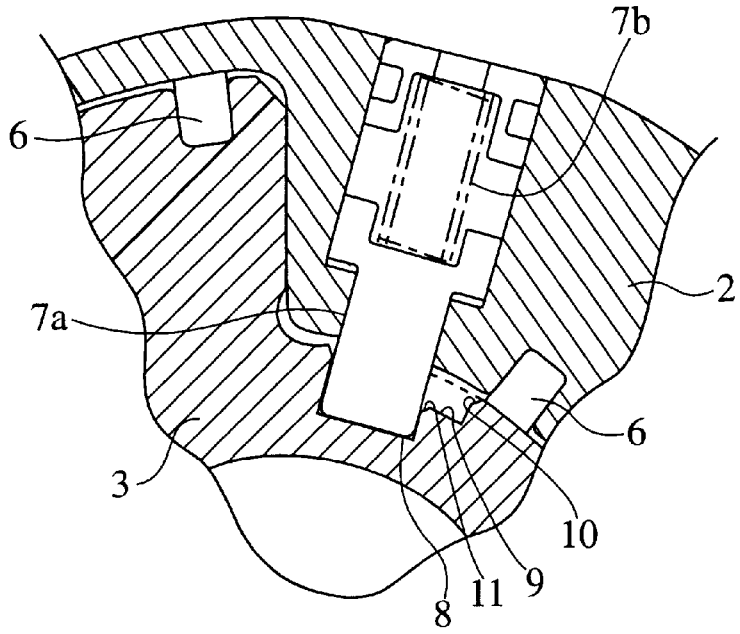
Figure 19B:
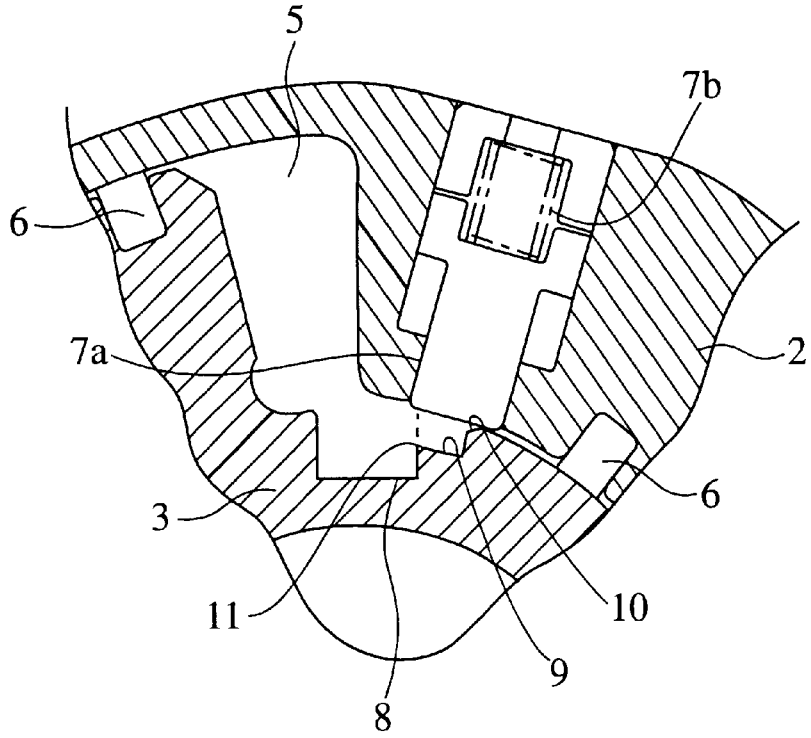

FIGS. 19A and 19B are sectional views showing the magnified locking mechanism in the valve timing adjusting apparatus according to a seventh embodiment of the present invention, wherein FIG. 19A is a sectional view showing the spring in its extended state, whereas FIG. 19B is a sectional view showing the spring in its compressed state. In this seventh embodiment, the load of the spring 7*b* that is urging the locking pin 7*a* in the diametrical inner direction of the apparatus is set in such a manner as to be larger than the centrifugal force applied to the locking pin 7*a* or the force equivalent to the pressure of the residual oil within the apparatus at the engine starting time, both in a state that the locking pin 7*a* has been fitted in the locking hole 8 (as shown in FIG. 19A when the spring is extended), and in a state that the locking pin 7*a* has been disengaged from the locking hole 8 (as shown in FIG. 19B when the spring is compressed). Due to this, even when, for example, the locking pin 7*a* has been disengaged from the locking hole 8, and there is still residual oil in the apparatus, when the rotor 3 is snapped during the cranking operation by the cam reaction force in the advancing direction, the locking pin 7*a* will never be hampered from being fitted into the locking hole 8 by the oil pressure of the residual oil in the apparatus, so that the locking pin 7*a* is perfectly fitted into the locking hole 8 and thereby cramping the rotor 3 with respect to the casing 2.

As explained heretofore, according to the present invention, since there is formed a stepped portion in the advancing side or the retarding side of the locking hole into which the locking member is fitted or from which it is disengaged, even when the rotor 3 is not cramped at the engine stopped state, the locking member can securely be fitted into the locking hole at the engine restarting time to cramp the rotor, whereby the generation of a strange noise and/or a vibration can be suppressed, and thus a stable engine starting operation can be assured.

Further, according to the present invention, since the stepped portion is made to substantially elongate or oval, the locking member can securely be fitted into the locking hole at the engine starting time, and thus a stable engine starting operation can be assured.

Further, according to the present invention, since the stepped portion is made in a punched-out shape in the axial direction of the apparatus, not only the locking member can securely be fitted into the locking hole at the engine starting time to assure a stable engine starting operation, but the machining process for forming the stepped portion can be obviated, lowering thereby the total cost for its manufacturing process.

Further, according to the present invention, since there are formed tapered portions respectively at the boarder between the external peripheral portion of the rotor and the stepped portion, and at the boarder between the locking hole and the stepped portion, wherein the taper formed at the boarder between the locking hole and the stepped portion is made shorter than that of the taper provided at the boarder between the external peripheral portion of the rotor and the stepped portion, yet the inclination angle of the former taper is greater than that of the later taper, whereby guiding the locking member to be fitted into the locking hole can be readily performed, and thus the locking efficiency between the locking member and the locking hole can be greatly improved.

Further, according to the present invention, since the end portion of the locking member is formed with a tapered portion whose inclination angle is equal to or greater than the taper provided at the boarder between the locking hole and the stepped portion, the locking efficiency between the locking member and the locking hole can be greatly improved.

Further, according to the present invention, since the end portion of the locking member is formed with a surface truncated into a C shape or an R shape which is equal to or larger than that of the taper provided at the boarder between the locking hole and the stepped portion, the locking efficiency between the locking member and the locking hole can be greatly improved.

Further, according to the present invention, since the area surrounding the stepped portion and the locking hole is processed by a quenching operation, even when the locking member is abutted, the locking hole is not worn out, improving thereby its durability.

Further, according to the present invention, since at least one of a plurality of advancing side hydraulic chambers is formed with a bias member for urging the rotor in the advancing direction, even when an oil pressure is not sufficiently provided to the valve timing adjusting apparatus such as the engine starting time, and residual oil remains in the hydraulic chamber, the rotor can be shifted in the advancing direction together with the cam reaction force, so that the rotor can be cramped at the most advanced position, and the instability of the rotor can be securely prevented, whereby the generation of a strange noise (drumming noise) and/or a vibration can be suppressed, and a stable engine starting operation can be thus assured.

Still further, according to the present invention, since the locking hole is formed at a position corresponding to the reference position at the engine starting time, which is between the most advanced position and the most retarded position, the shifting movement from the reference position to both the most advanced and retarded positions is enabled, increasing thereby the controlling variations as a valve timing adjusting apparatus.

Still further, according to the present invention, since the valve timing adjusting apparatus capable of shifting in both the advancing and retarding directions is provided at the exhaust side camshaft, by controlling the exhaust valve to shift in the advancing direction at the engine starting time, a high-temperature gas immediately after the explosion within the engine cylinder can be fed to a catalyst side as an exhaust gas, and thus the temperature of the catalyst can be raised abruptly to the grade higher than the activation temperature, so that even if the engine is started at low temperature, detrimental substance contained within the exhaust gas passing through the catalyst can be efficiently rendered harmless. Thus, not only during the normal operating state, but even at the engine starting time, detrimental substance to be exhausted into the air can be reduced, and an environmental disruption can thereby be avoided. In addition, by controlling the exhaust valve in the advancing direction even during the normal operation, an overall torque rate can also be enhanced.

Still further, according to the present invention, since the valve timing adjusting apparatus capable of shifting in both the advancing and retarding directions is provided at the intake side camshaft, the fuel efficiency or minimization of emission can also be obtained by controlling the apparatus in the advancing direction just as the conventional case.

Still further, according to the present invention, since the locking member is composed of a far end portion which is formed in a tapered shape, or truncated into a C shape, or even an R shape, and a parallel portion, even when a force in the diametrical direction is applied to the locking member, no "twisting" phenomenon is caused to the locking member, and thus the locking member can securely be disengaged from the locking hole, whereby a stable operability of the apparatus can be obtained.

Still further, according to the present invention, since the load of the spring that is urging the locking member in the diametrical direction of the apparatus is set in such a manner as to be larger than the centrifugal force applied to the locking member or larger than the force equivalent to the pressure of the residual oil within the apparatus at the engine starting time, even when the rotor is snapped by the cam reaction force in the advancing direction during the period of the cranking operation, the locking member will never be hampered from being fitted into the locking hole by the residual oil pressure in the apparatus, so that the locking member is fully fitted into the locking hole and thereby cramp the rotor with respect to the casing.

Yet still further, according to the present invention, since, even in a state that the locking member has been fitted into the locking hole formed in the external peripheral surface of the rotor, namely in a state that the spring urging the locking member in the diametrically inner direction of the apparatus is at the most extended state, the load of the spring is set in such a manner as to be larger than the centrifugal force applied to the locking member or the force equivalent to the pressure of the residual oil in the apparatus at the engine starting time, even when the rotor is snapped by the cam reaction force in the advancing direction during the period of the cranking operation, the locking member will never be hampered from being fitted into the locking hole by the residual oil pressure in the apparatus, so that the locking member is fully fitted into the locking hole and thereby cramp the rotor with respect to the casing.

What is claimed is:

1. A valve timing adjusting apparatus comprising:

a shoe case, which rotates in synchronism with a crankshaft of an engine side, and having a plurality of shoes which are protruded from the inner surface of said shoe case and composing a plurality of hydraulic chambers, a rotor, which is rotatably accommodated in said shoe case, and is formed with a plurality of vanes, said vanes dividing each of said plurality of hydraulic chambers into an advancing hydraulic chamber and a retarding hydraulic chamber, and a locking member, which is shiftable in the radial direction of said rotor, and can be at least one of fitted in and disengaged from a locking hole formed in the external peripheral surface of said rotor, wherein there is further formed a stepped portion in the external peripheral surface of said rotor in a continuing manner from said locking hole at a position deviated from said locking hole either in the advancing direction or retarding direction, said stepped portion being formed lower than said external peripheral surface, yet higher than the bottom of said locking hole.

2. The valve timing adjusting apparatus according to claim 1, wherein said stepped portion is made in a punched-out shape in the axial direction of the apparatus.

3. The valve timing adjusting apparatus according to claim 1, wherein at least one of said plurality of advancing hydraulic chambers is formed with a bias member for urging said rotor in the advancing direction.

4. The valve timing adjusting apparatus according to claim 1, wherein said locking hole is formed at a position corresponding to the reference position at the engine starting time, which is between the most advanced position and the most retarded position.

5. The valve timing adjusting apparatus according to claim 4, wherein said locking hole is provided at the exhaust side camshaft.

6. The valve timing adjusting apparatus according to claim 4, wherein said locking hole is provided at the intake side camshaft.

7. A valve timing adjusting apparatus comprising:

a shoe case, which rotates in synchronism with a crankshaft of an engine side, and having a plurality of shoes which are protruded from the inner surface of said shoe case and composing a plurality of hydraulic chambers, a rotor, which is rotatably accommodated in said shoe case, and is formed with a plurality of vanes, said vanes dividing each of said plurality of hydraulic chambers into an advancing hydraulic chamber and a retarding hydraulic chamber, and a locking member, which is shiftable in the radial direction of said rotor, and can be at least one of fitted in and disengaged from a locking hole formed in the external peripheral surface of said rotor, wherein there is further formed a stepped portion in the external peripheral surface of said rotor in a continuing manner from said locking hole at a position deviated from said locking hole either in the advancing direction or retarding direction, said stepped portion being formed lower than said external peripheral surface, yet higher than the bottom of said locking hole, and wherein said stepped portion is formed to be a substantially elongate hole.

8. The valve timing adjusting apparatus according to claim 7, wherein at least one of said plurality of advancing hydraulic chambers is formed with a bias member for urging said rotor in the advancing direction.

9. A valve timing adjusting apparatus comprising:

a shoe case, which rotates in synchronism with a crankshaft of an engine side, and having a plurality of shoes which are protruded from the inner surface of said shoe case and composing a plurality of hydraulic chambers, a rotor, which is rotatably accommodated in said shoe case, and is formed with a plurality of vanes, said vanes dividing each of said plurality of hydraulic chambers into an advancing hydraulic chamber and a retarding hydraulic chamber, and a locking member, which is shiftable in the radial direction of said rotor, and can be at least one of fitted in or disengaged from a locking hole formed in the external peripheral surface of said rotor, wherein there is further formed a stepped portion in the external peripheral surface of said rotor in a continuing manner from said locking hole at a position deviated from said locking hole either in the advancing direction or retarding direction, said stepped portion being formed lower than said external peripheral surface, yet higher than the bottom of said locking hole, and wherein two tapers are formed each at the border between the external peripheral portion of said rotor and said stepped portion, and at the border between said locking hole and said stepped portion, wherein the taper formed at the border between said locking hole and said stepped portion is made shorter, yet its inclination angle is greater, in comparison with the length and the inclination angle of the taper provided at the border between the external peripheral portion of said rotor and said stepped portion.

10. The valve timing adjusting apparatus according to claim 9, wherein the end portion of said locking member is formed with a tapered portion whose inclination angle is equal to or larger than that of said taper provided at the border between said locking hole and said stepped portion.

11. The valve timing adjusting apparatus according to claim 9, wherein the end portion of said locking member is formed with a surface truncated into a C shape or an R shape, which is larger than that of said taper provided at the border between said locking hole and said stepped portion.

12. The valve timing adjusting apparatus according to claim 11, wherein the area surrounding said stepped portion and said locking hole is processed by a quenching finish.

13. The valve timing adjusting apparatus according to claim 9, wherein at least one of said plurality of advancing hydraulic chambers is formed with a bias member for urging said rotor in the advancing direction.

* * * * *